US010642174B2

(12) United States Patent
Kobayashi

(10) Patent No.: US 10,642,174 B2
(45) Date of Patent: May 5, 2020 bbe
(54) ELECTROCONDUCTIVE SUPPORT BODY AND METHOD FOR MANUFACTURING SAME, ELECTROPHOTOGRAPHIC PHOTORECEPTOR, AND ELECTROPHOTOGRAPHIC DEVICE

(71) Applicant: FUJI ELECTRIC CO., LTD., Kawasaki-shi, Kanagawa (JP)

(72) Inventor: Hirotaka Kobayashi, Matsumoto (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 16/549,320

(22) Filed: Aug. 23, 2019

(65) Prior Publication Data

US 2019/0384191 A1 Dec. 19, 2019

Related U.S. Application Data

(63) Continuation of application No. PCT/JP2017/037750, filed on Oct. 18, 2017.

(51) Int. Cl.

| | |
|---|---|
| ***G03G 15/00*** | (2006.01) |
| ***G03G 5/10*** | (2006.01) |
| ***G03G 5/043*** | (2006.01) |
| ***G03G 5/05*** | (2006.01) |
| ***G03G 15/08*** | (2006.01) |

(52) U.S. Cl.

CPC ..... *G03G 5/102* (2013.01); *G03G 5/0436* (2013.01); *G03G 5/0567* (2013.01); *G03G 5/10* (2013.01); *G03G 15/0808* (2013.01); *G03G 2215/025* (2013.01)

(58) Field of Classification Search

CPC ..... G03G 5/10; G03G 5/102
USPC ..... 399/159
See application file for complete search history.

(56) References Cited

U.S. PATENT DOCUMENTS

| | | | | |
|---|---|---|---|---|
| 10,095,136 | B2 * | 10/2018 | Sekiya et al. | G03G 5/14 |
| 2012/0114379 | A1 | 5/2012 | Yamashita et al. | |
| 2014/0044456 | A1 | 2/2014 | Yamashita et al. | |

FOREIGN PATENT DOCUMENTS

| | | | |
|---|---|---|---|
| JP | S58-173750 | A | 10/1983 |
| JP | 2000-313947 | A | 11/2000 |
| JP | 2003-162078 | A | 6/2003 |
| JP | 2003-186211 | A | 7/2003 |
| JP | 2004-109918 | A | 4/2004 |
| JP | 2005-099637 | A | 4/2005 |
| JP | 2009-050988 | A | 3/2009 |

(Continued)

*Primary Examiner* — William J Royer
(74) *Attorney, Agent, or Firm* — Rabin & Berdo, P.C.

(57) ABSTRACT

An electrically conductive support for use in an electrophotographic photoreceptor includes a cylindrical main body having a first end and a second end opposite to the first end in an axial direction of the main body. The main body contains an aluminum alloy and has an internal stress in a range of −30 MPa to 5 MPa. A method of producing the electrically conductive support includes preparing a substrate containing an aluminum alloy obtained at least through an extrusion step, and heat treating the substrate to obtain the electrically conductive support. The heat treating is carried out such that, when a temperature of the heat treating is defined as T (° C.) and a time of the heat treating is defined as H (hours), an amount of the heat treating Q defined by Q=T×H is 800 or less.

9 Claims, 3 Drawing Sheets

(56) References Cited

FOREIGN PATENT DOCUMENTS

| | | | |
|---|---|---|---|
| JP | 2009-150958 | A | 7/2009 |
| JP | 2009-186672 | A | 8/2009 |
| JP | 2010-230989 | A | 10/2010 |
| JP | 2012-103473 | A | 5/2012 |
| JP | 2014-038136 | A | 2/2014 |

* cited by examiner

ELECTROCONDUCTIVE SUPPORT BODY AND METHOD FOR MANUFACTURING SAME, ELECTROPHOTOGRAPHIC PHOTORECEPTOR, AND ELECTROPHOTOGRAPHIC DEVICE

CROSS REFERENCE TO RELATED APPLICATIONS

This is a continuation application of International Application PCT/JP2017/037750 filed on Oct. 18, 2017, the contents of which are incorporated herein by reference.

BACKGROUND OF THE INVENTION

Technical Field

The present invention relates to an electrophotographic photoreceptor (hereinafter, also simply referred to as a "photoreceptor") which is used in a printer, a copying machine or a facsimile machine employing an electrophotographic system, a method of producing the same, and an electrophotographic device.

Background Art

An electrophotographic photoreceptor includes: an electrically conductive support; and a photosensitive layer provided on the electrically conductive support and having a photoconductive function. In recent years, research and development have been actively carried out on organic electrophotographic photoreceptors in which organic compounds are used as functional components responsible for the generation and the transport of electric charges, because of their advantages in material diversity, high productivity, safety and the like, and the applications of these organic electrophotographic photoreceptors in copying machines and printers are in progress.

In general, a photoreceptor needs to have: a function of retaining surface charges in a dark place; a function of receiving light and generating electric charges; and further, a function of transporting the generated electric charges. As such a photoreceptor, there are known a so-called monolayer photoreceptor, which includes a monolayer photosensitive layer having all of the above described functions; and a so-called laminated (function-separated) photoreceptor, which includes a photosensitive layer obtained by laminating layers each having separated functions, namely: a charge generation layer mainly responsible for the function of generating electric charges upon light reception; and a charge transport layer responsible for the function of retaining surface charges in a dark place and the function of transporting the electric charges generated in the charge generation layer upon light reception.

In general, the photosensitive layer is formed by: preparing a coating liquid in which functional materials such as a charge generation material and a charge transport material, and a resin binder are dissolved or dispersed in an organic solvent; and coating the coating liquid on an electrically conductive support made of an aluminum alloy. The electrically conductive support made of an aluminum alloy is usually produced from an ingot containing the aluminum alloy, through an extrusion step, a drawing step and a cutting step. Prior art techniques regarding the method of producing such an electrically conductive support made of an aluminum alloy can be found, for example, in Patent Document 1, which disclose a technique regarding a method of producing a support for use in a cylindrical electrophotographic photoreceptor.

RELATED ART DOCUMENT

Patent Document

Patent Document 1: JP2009-150958A

SUMMARY OF THE INVENTION

With recent developments in color printers and increased popularity thereof, printers employing an electrophotographic system tend to have an increasingly higher printing speed, a smaller device size, and a reduced number of constituent members. As a result, there is an increased demand for printers having a higher quality, such as a higher resolution and a longer life, as well as a lower cost. Accordingly, an electrophotographic photoreceptor to be used in an electrophotographic device is also required to have a higher quality, such as a higher resolution and a longer life, as well as a lower cost.

To obtain a high resolution image, it is important that not only a photoreceptor but also an electrically conductive support used therein have a high accuracy. In the case of an electrophotographic device including a plurality of photoreceptors, for example, it is required that each of the electrically conductive supports have a high accuracy, and in particular, a small deflection. In addition, it is also required that the variation in deflection between the plurality of electrically conductive supports be small. However, electrically conductive supports made of an aluminum alloy and obtained through the above described steps have a problem that a variation in deflection is likely to occur between production lots and between substrates. When there is a variation in deflection between the electrically conductive supports, the variation is also reflected in the photoreceptors produced using the electrically conductive supports, possibly resulting in a problem of image malfunction. Therefore, there has been a demand for achieving a technique which allows for reducing the deflection of each electrically conductive support so as to reduce the variation in deflection between respective supports, thereby enabling to provide a photoreceptor which allows for obtaining a high resolution.

In view of the above, an object of the present invention is to provide: a highly-accurate electrically conductive support and a method of producing the same; an electrophotographic photoreceptor which allows for obtaining a high resolution by using the electrically conductive support; as well as an electrophotographic device using the same.

The present inventors have found out, as a result of intensive studies, that it is possible to solve the above-mentioned problems by employing the following constitutions, thereby completing the present invention.

In other words, an electrically conductive support according to a first embodiment of the present invention is an electrically conductive support for use in an electrophotographic photoreceptor, the electrically conductive support including:

a cylindrical main body;

a first end of the main body in the longitudinal direction; and a second end of the main body opposite to the first end;

wherein the main body contains an aluminum alloy, and the main body has a stress value within a range of −30 MPa or more and 5 MPa or less.

In this case, it is preferred that the main body be a cylindrical tube, and the cylindrical tube have the first end in the longitudinal direction and the second end opposite to the first end, and have a constant inner diameter and outer diameter between the first end and the second end. In particular, the cylindrical tube more preferably has an outer diameter of 40 mm or less, and a thickness of 0.5 mm or more and 0.8 mm or less. Further, the cylindrical tube preferably has a deflection of 30 μm or less.

A method of producing an electrically conductive support according to a second embodiment of the present invention is a method of producing the above described electrically conductive support, the method including:

preparing a substrate which contains an aluminum alloy and which is obtained at least through an extrusion step; and heat treating the substrate to obtain the electrically conductive support;

wherein the heat treating is carried out such that, when the temperature of the heat treatment is defined as T (° C.) and the time of the heat treatment is defined as H (hours), the amount of heat treatment Q defined by Q=T×H is 800 or less.

An electrophotographic photoreceptor according to a third embodiment of the present invention is an electrophotographic photoreceptor including: the above described electrically conductive support; and a photosensitive layer formed on the main body. In this case, the photosensitive layer preferably contains an inorganic or organic filler. Further, the photosensitive layer preferably contains at least a resin binder and a charge transport material.

An electrophotographic device according to a fourth embodiment of the present invention is an electrophotographic device including the above described electrophotographic photoreceptor.

According to the present invention, it is possible to obtain: a highly-accurate electrically conductive support and a method of producing the same; an electrophotographic photoreceptor which allows for obtaining a high resolution; as well as an electrophotographic device using the same.

DETAILED DESCRIPTION OF THE INVENTION

Specific embodiments of the present invention will now be described in detail, with reference to drawings. The present invention is in no way limited by the following description.

Figure 1:
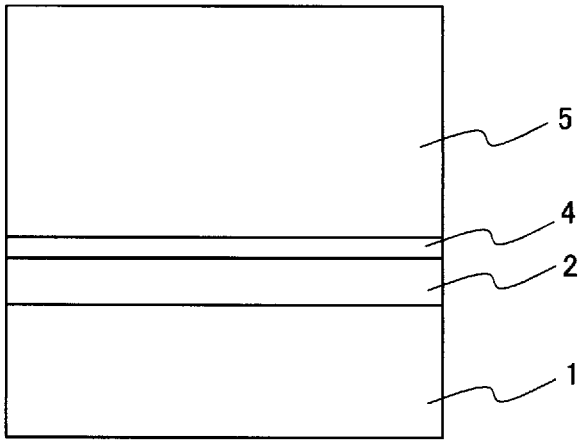
FIG. 1 is a schematic sectional view showing a negatively-charged laminated electrophotographic photoreceptor as one example of an electrophotographic photoreceptor according to the present invention.
Figure 2:
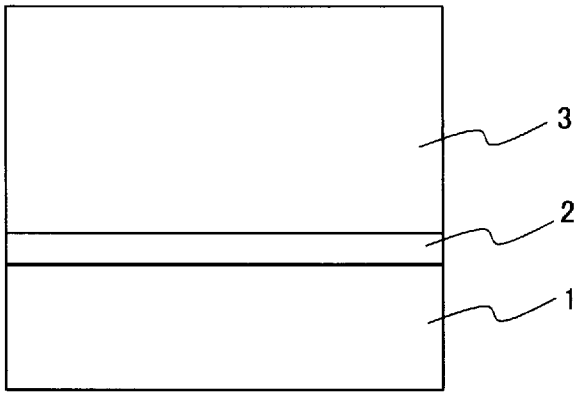
FIG. 2 is a schematic sectional view showing a positively-charged monolayer electrophotographic photoreceptor as another example of the electrophotographic photoreceptor according to the present invention.
Figure 3:
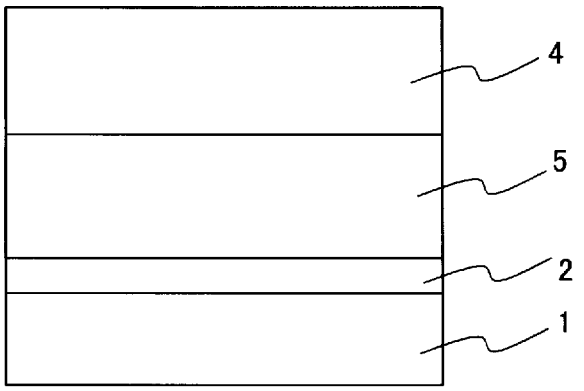
FIG. 3 is a schematic sectional view showing a positively-charged laminated electrophotographic photoreceptor as still another example of the electrophotographic photoreceptor according to the present invention.

As described above, electrophotographic photoreceptors are roughly classified into: so-called negatively-charged laminated photoreceptors and positively-charged laminated photoreceptors, as laminated (function-separated) photoreceptors; and monolayer photoreceptors mainly used as positively-charged photoreceptors. FIGS. 1 to 3 are schematic sectional views each showing one example of the electrophotographic photoreceptor according to the present invention. FIG. 1 shows a laminated electrophotographic photoreceptor used in a negatively-charged electrophotographic process. FIG. 2 shows a monolayer electrophotographic photoreceptor used in a positively-charged electrophotographic process. FIG. 3 shows a laminated electrophotographic photoreceptor used in a positively-charged electrophotographic process.

As shown in the figures, in the negatively-charged laminated photoreceptor, an undercoat layer 2; and a photosensitive layer including a charge generation layer 4 having a charge generation function and a charge transport layer 5 having a charge transport function; are sequentially laminated on an electrically conductive support 1. Further, in the positively-charged monolayer photoreceptor, an undercoat layer 2; and a monolayer photosensitive layer 3 having both a charge generation function and a charge transport function; are sequentially laminated on an electrically conductive support 1. Still further, in the positively-charged laminated photoreceptor, an undercoat layer 2; and a photosensitive layer including a charge transport layer 5 having a charge transport function and a charge generation layer 4 having both a charge generation function and a charge transport function; are sequentially laminated on an electrically conductive support 1. It is noted that the undercoat layer 2 may be provided as required, in any of these types of the photoreceptors.

Figure 4:
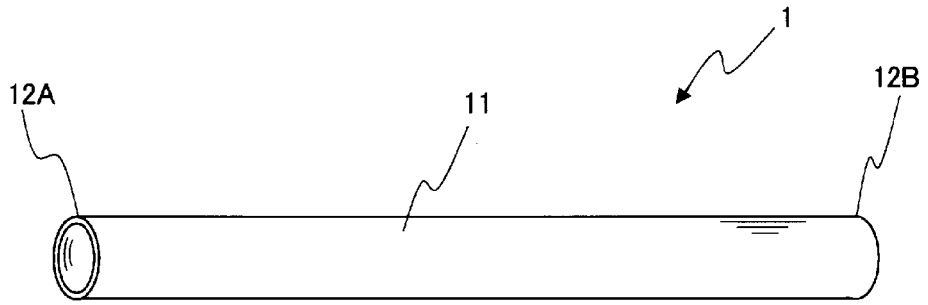
FIG. 4 is a schematic perspective view showing one example of an electrically conductive support according to the present invention.

FIG. 4 shows a schematic perspective view of one example of the electrically conductive support according to the present invention. An electrically conductive support 1 according to the present invention includes: a cylindrical main body 11; a first end 12A of the main body 11 in the longitudinal direction (axial direction); a second end 12B of the main body 11 opposite to the first end 12A; wherein the main body 11 contains an aluminum alloy, and the main body 11 has an internal stress. The value of the internal stress (stress value) is in a range of −30 MPa to 5 MPa.

By adjusting the stress value of the electrically conductive support 1 within the range of −30 MPa or more and 5 MPa or less, it has become possible not only to obtain the electrically conductive support 1 having a small deflection, but also to obtain an electrophotographic photoreceptor which allows for obtaining a high resolution. In other words, although electrically conductive supports made of an aluminum alloy and produced through the extrusion step, the cutting step and the like, as described above, have a problem that a variation in deflection is likely to occur between production lots and between substrates, it is possible to reduce the variation in deflection between the electrically conductive supports by adjusting the stress value within the above described range. As a result, a photoreceptor which allows for obtaining a high resolution can be obtained. When the stress value is lower than the above described range, the accuracy of the electrically conductive supports is reduced, to cause image malfunction. When the stress value is higher than the above described range, the rigidity of the electrically conductive support is reduced. The electrically conductive support 1 preferably has a stress value within a range of −30 MPa or more and 0 MPa or less, and more preferably within a range of −20 MPa or more and 0 MPa or less. The electrically conductive support 1 having a stress value of −30 MPa or more and 0 MPa or less has a desirable rigidity. The electrically conductive support 1 having a stress value of −20 MPa or more 0 MPa or less has both a desirable deflection accuracy and a desirable rigidity. A heat treatment to be described later can be used, for example, as a means for adjusting the stress value of the electrically conductive support 1 within the above described predetermined range.

In the present invention, the stress value of the electrically conductive support 1 can be measured using a stress value measuring apparatus employing a micro X-RAY stress measurement system, as a measuring apparatus capable of measuring the internal stress of the electrically conductive support 1. Specifically, Auto Mate II manufactured by Rigaku Corporation can be used, for example, as the measuring apparatus. In this apparatus, an X-RAY is irradiated to an object to be measured, and the X-RAY diffracted (reflected) inside the object is measured. The diffraction angle of the X-RAY varies depending on the atomic spacing within the object to be measured, and the atomic spacing expands and contracts depending on the residual stress. Therefore, it is possible to obtain the internal stress value of the object, which is a factor causing the expansion and contraction, by measuring the amount of change in diffraction angle associated with the expansion and contraction.

The electrically conductive support 1 to be used in the present invention is required to be one containing an aluminum alloy, and is usually produced from an ingot of an aluminum alloy, through at least the extrusion step and the cutting step, or through the extrusion step, the drawing step and the cutting step. Examples of the material of the aluminum alloy which can be used include aluminum alloys A1050, A3003, A5052, A5056, A6061 and A6063, but not particularly limited thereto. The aluminum alloy may be an aluminum alloy having a purity of 99.00% or more, an alloy obtained by adding manganese to aluminum, an alloy obtained by adding magnesium to aluminum, or an alloy obtained by adding magnesium and silicon to aluminum. The aluminum alloy may contain unavoidable impurities.

The electrically conductive support 1 serves as an electrode of a photoreceptor, and at the same time, serves as a support for respective layers constituting the photoreceptor. The electrically conductive support 1 may have any shape, such as a cylindrical shape, a plate-like shape or a film-like shape. However, the electrically conductive support 1 preferably has a cylindrical shape such as one shown in FIG. 4, in particular. The present invention is useful, when the electrically conductive support 1 is a cylindrical tube having two ends in the longitudinal direction, and when the cylindrical tube has an inner diameter and an outer diameter which are constant between the two ends. The two ends of the cylindrical tube may be open ends. In addition to the shape a straight tube, the electrically conductive support 1 having a cylindrical shape can be formed to have a tubular shape including a so-called spigot joint portion, which is a portion having an increased inner diameter, provided at an end portion in the longitudinal direction. Although a support including a spigot joint portion requires a processing cost for forming the spigot joint portion, a higher accuracy is more easily achieved since cutting processing can be carried out using the spigot joint portion as a reference point. In contrast, a straight tube is inexpensive in terms of cost, but a higher accuracy is less easily achieved as compared to a tube including a spigot joint portion. Accordingly, when the present invention is applied to the electrically conductive support 1 which is a straight tube, there is an advantage that not only the electrically conductive support 1 but also the photoreceptor having a high accuracy can be obtained, in a more inexpensive manner. The electrically conductive support 1 is not particularly limited. However, one having a small size with an outer diameter of about 40 mm or less, and having a thin wall with a thickness of about 0.5 mm or more and 0.8 mm or less, for example, is inexpensive, and thus is suitable. When the stress value of the electrically conductive support 1 having a small size and a thin wall is adjusted within the range defined in the present invention, a greater advantage can be obtained as compared to the case of the electrically conductive support 1 having a large size and a thick wall.

The electrically conductive support 1 which is a cylindrical tube preferably has a deflection of 30 μm or less, more preferably 25 μm or less, and particularly preferably 20 μm or less; namely, the smaller the deflection, the better. It is preferred to adjust the deflection within the above described range, so that the resulting photoreceptor allows for providing a high resolution.

The photoreceptor according to the present invention includes the electrically conductive support 1; and a photosensitive layer formed on the main body of the electrically conductive support 1. In the photoreceptor according to the present invention, the electrically conductive support 1 is required to have a stress value satisfying the above described range, and this enables to obtain the expected effects of the present invention. The configurations of the constituents other than the electrically conductive support 1 are not particularly limited, and can be selected as appropriate.

The present invention is used, in particular, in an organic electrophotographic photoreceptor including a photosensitive layer (referred to as an "organic photosensitive layer") which contains organic compounds as functional components responsible for the generation and the transport of electric charges. In other words, in the case of an inorganic photoreceptor prepared using an inorganic material such as a-Si, it is necessary to take into consideration the effect of heat on the electrically conductive support during the film formation of the photosensitive layer, since the electrically conductive support is heated to a high temperature during the film formation of the photosensitive layer. However, in the case of an organic photoreceptor, there is no need to heat the electrically conductive support during the film formation of photosensitive layer, as is necessary in the case of an inorganic photoreceptor, and accordingly, the accuracy of the electrically conductive support solely affects the shape of the photoreceptor. Therefore, the present invention is useful when used in an organic photoreceptor. The photosensitive layer preferably contains at least a resin binder and a charge transport material.

The undercoat layer 2 is composed of a layer containing a resin as a main component, or a metal oxide film of alumite or the like. Such an undercoat layer 2 is provided, as required, for the purposes of: controlling the ability to inject electric charges from the electrically conductive support 1 to the photosensitive layer; covering defects on the surface of the electrically conductive support; and improving the adhesion between the photosensitive layer and the electrically conductive support 1, and the like. Examples of the resin material to be used in the undercoat layer 2 include: insulating polymers such as casein, polyvinyl alcohol, polyamide, melamine and cellulose; and conductive polymers such as polythiophene, polypyrrole and polyaniline. These resins can be used singly, or can be mixed and used in an appropriate combination. Further, these resins may contain a metal oxide such as titanium dioxide or zinc oxide.

(Negatively-Charged Laminated Photoreceptor)

In cases where the photoreceptor according to the present invention is a negatively-charged laminated electrophotographic photoreceptor, the photosensitive layer includes the charge generation layer 4 and the charge transport layer 5 in this order from the side of the electrically conductive support 1.

In the negatively-charged laminated photoreceptor, the charge generation layer 4 is formed, for example, by a method of coating a coating liquid obtained by dispersing particles of a charge generation material in a resin binder, and the thus formed layer 4 receives light and generates electric charges. It is important that the charge generation layer 4 have a high charge generation efficiency, and at the same time, an ability to inject the generated electric charges into the charge transport layer 5. Further, it is desirable that the charge generation layer 4 be less dependent on the electric field and have an effective injectability even at low electric fields.

Examples of the charge generation material include: phthalocyanine compounds such as X-type metal-free phthalocyanine, τ-type metal-free phthalocyanine, α-type titanyl phthalocyanine, β-type titanyl phthalocyanine, Y-type titanyl phthalocyanine, γ-type titanyl phthalocyanine, amorphous titanyl phthalocyanine and ε-type copper phthalocyanine; and pigments such as various types of azo pigments, anthanthrone pigments, thiapyrylium pigments, perylene pigments, perinone pigments, squarylium pigments and quinacridone pigments. These compounds can be used singly or in an appropriate combination, and any suitable substance can be selected depending on the wavelength region of an exposure light source which is used in the image formation. In particular, a phthalocyanine compound can be suitably used. It is also possible to form the charge generation layer 4 using the charge generation material as a main component, and adding thereto a charge transport material and the like.

Examples of the resin binder to be used in the charge generation layer 4 include polymers and copolymers of polycarbonate resins, polyester resins, polyamide resins, polyurethane resins, vinyl chloride resins, vinyl acetate resins, phenoxy resins, polyvinyl acetal resins, polyvinyl butyral resins, polystyrene resins, polysulfone resins, diallyl phthalate resins and methacrylate resins; which can be used in an appropriate combination.

The content of the charge generation material in the charge generation layer 4 is suitably from 20 to 80% by mass, and more suitably from 30 to 70% by mass, with respect to the solid content of the charge generation layer 4. Further, the content of the resin binder in the charge generation layer 4 is suitably from 20 to 80% by mass, and more suitably from 30 to 70% by mass, with respect to the solid content of the charge generation layer 4. Since the charge generation layer 4 is only required to have a charge generation function, the charge generation layer 4 generally has a film thickness of 1 μm or less, suitably 0.5 μm or less.

In the case of the negatively-charged laminated photoreceptor, the charge transport layer 5 is the outermost surface layer of the photoreceptor. In the negatively-charged laminated photoreceptor, the charge transport layer 5 is mainly composed of a charge transport material and a resin binder.

Examples of the resin binder to be used in the charge transport layer 5 include: polyarylate resins; and various types of polycarbonate resins such as bisphenol A polycarbonates, bisphenol Z polycarbonates, bisphenol C polycarbonates, bisphenol A polycarbonate-biphenyl copolymers and bisphenol Z polycarbonate-biphenyl copolymers. These resins can be used singly, or a plurality of these can be used as a mixture. Further, the same kind of resins having different molecular weights may be used as a mixture. Other examples of the resin binder which can be used include polyphenylene resins, polyester resins, polyvinyl acetal resins, polyvinyl butyral resins, polyvinyl alcohol resins, vinyl chloride resins, vinyl acetate resins, polyethylene resins, polypropylene resins, acrylic resins, polyurethane resins, epoxy resins, melamine resins, silicone resins, polyamide resins, polystyrene resins, polyacetal resins, polysulfone resins and methacrylate polymers, and copolymers of these resins.

The above described resin suitably has a weight average molecular weight, as measured by GPC (gel permeation chromatography) analysis in terms of polystyrene, of from 5,000 to 250,000, and more suitably from 10,000 to 200,000.

Further, examples of the charge transport material to be used in the charge transport layer 5 include various types of hydrazone compounds, styryl compounds, diamine compounds, butadiene compounds, indole compounds and aryl amine compounds; and these compounds can be used singly, or can be mixed and used in an appropriate combination. Examples of such a charge transport material include compounds represented by the following formulae (II-1) to (II-30), but not limited thereto.

II-1

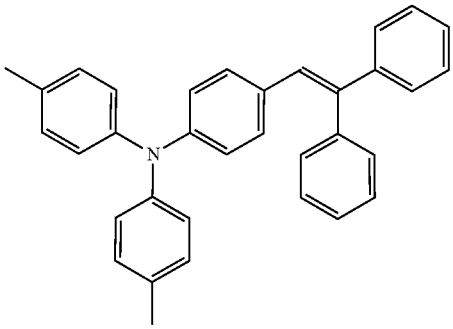

II-2

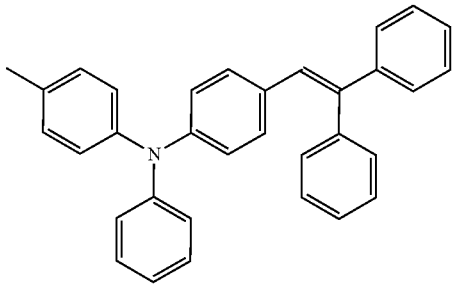

-continued
II-3
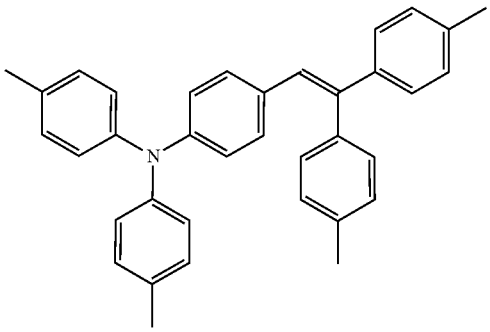
II-4
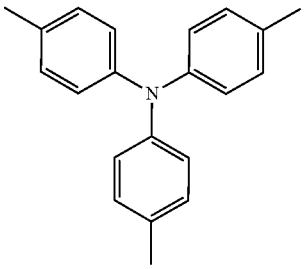
II-5
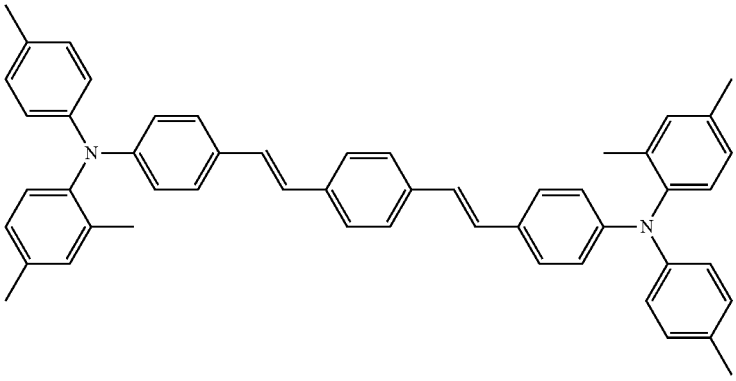
II-6
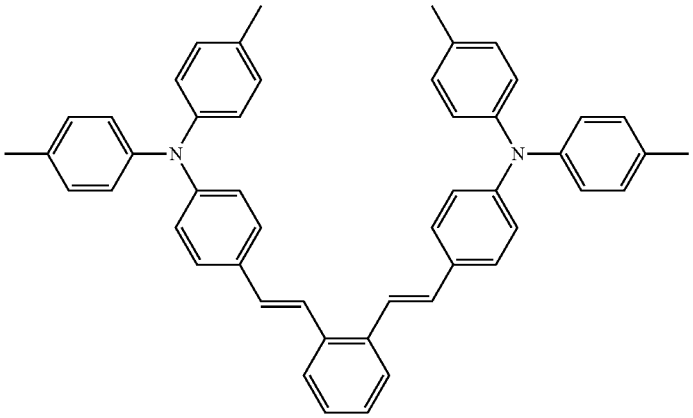
II-7
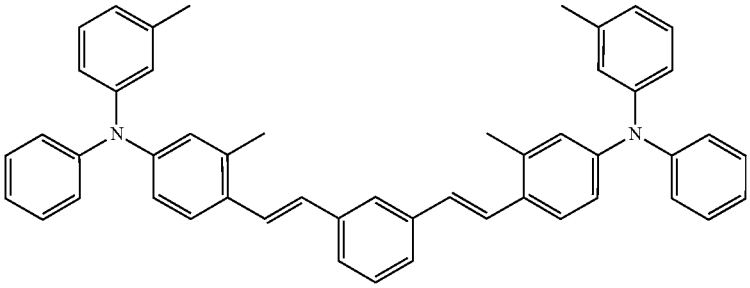

-continued
II-8
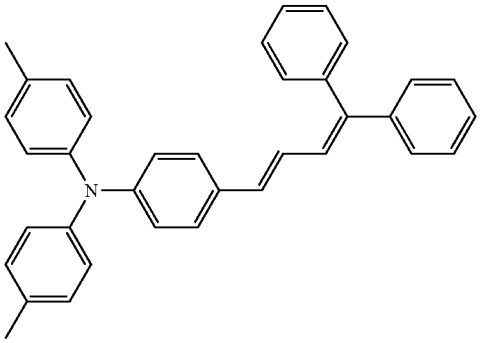
II-9
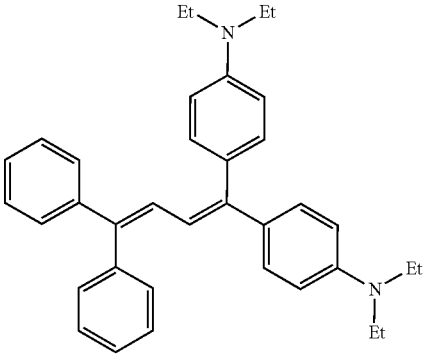
II-10
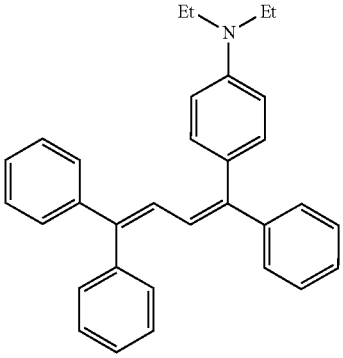
II-11
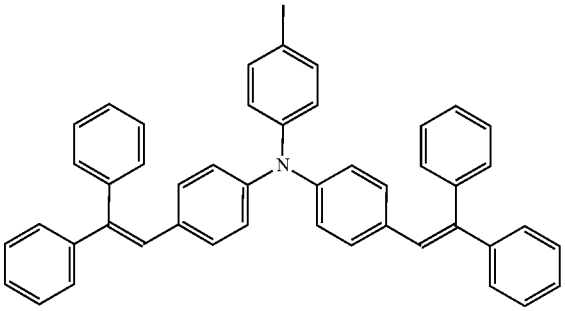
II-12
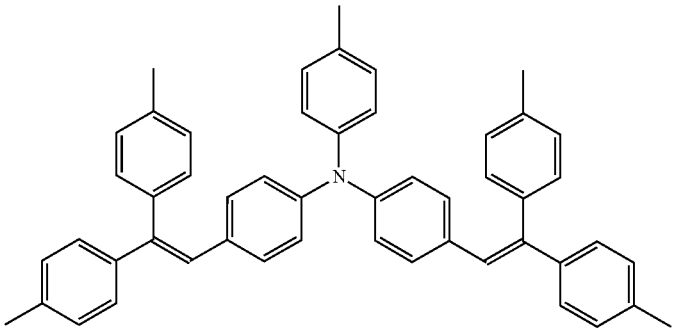
II-13
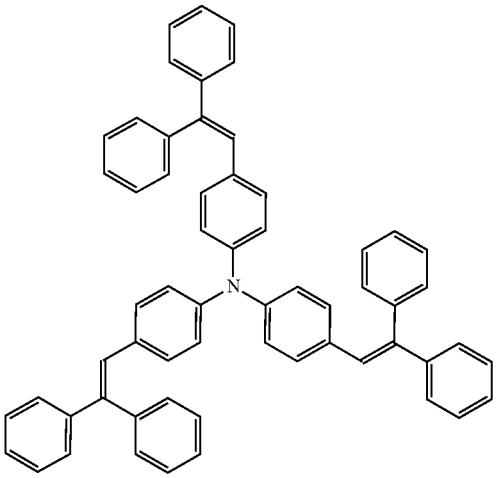
II-14
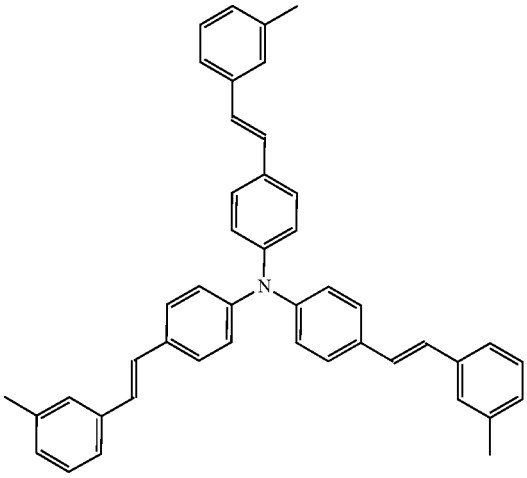

-continued
II-15
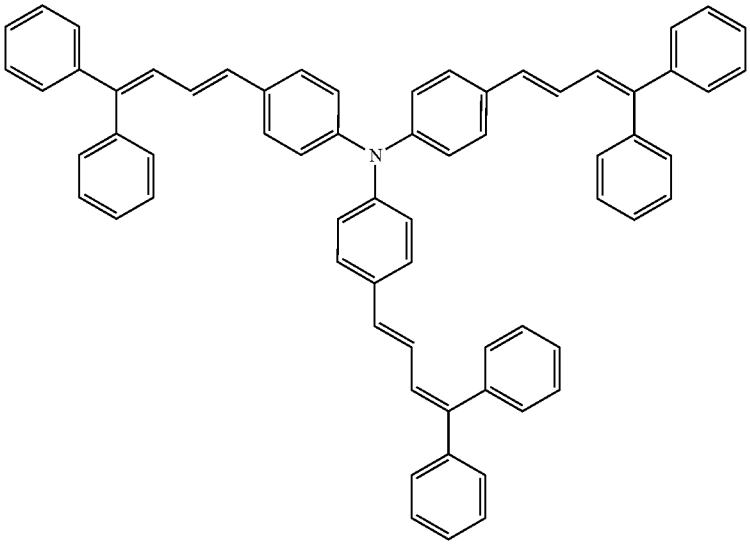
II-16
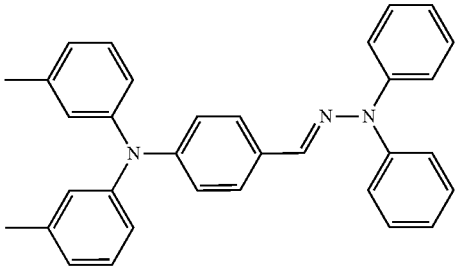
II-17
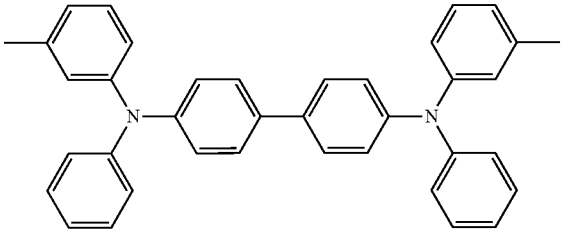
II-18
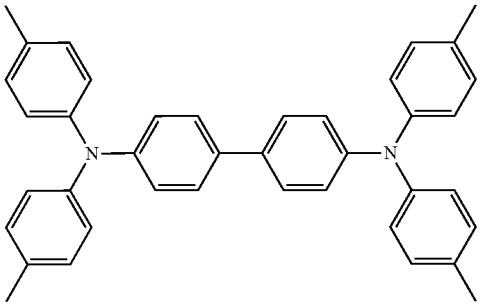
II-19
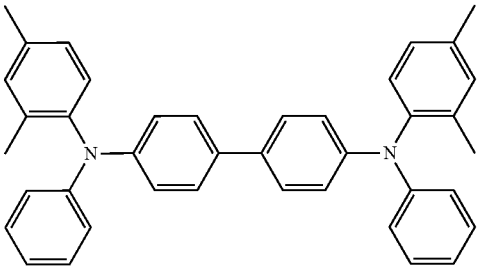
II-20
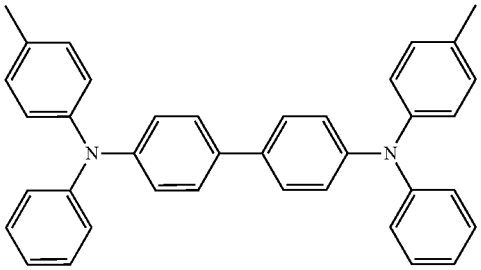
II-21
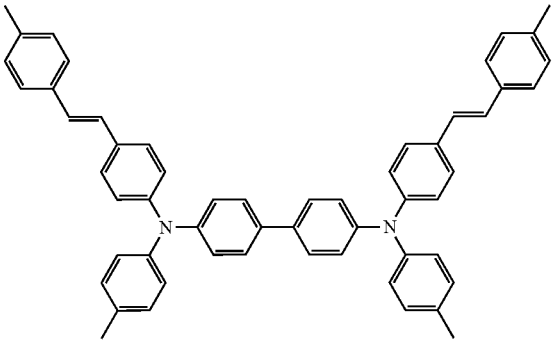

-continued
II-22
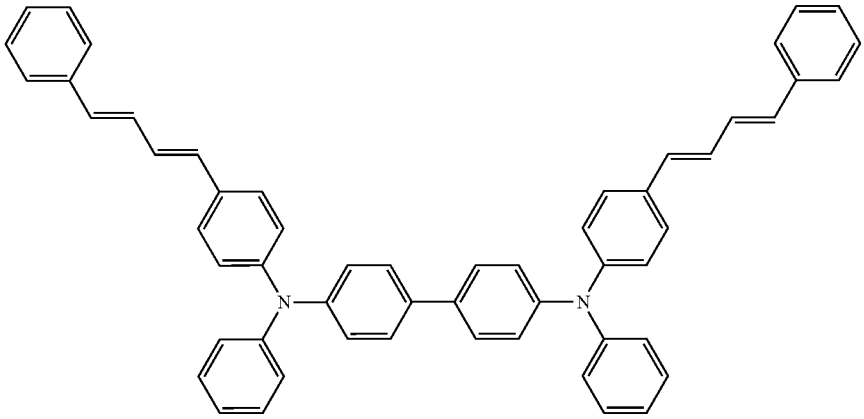
II-23
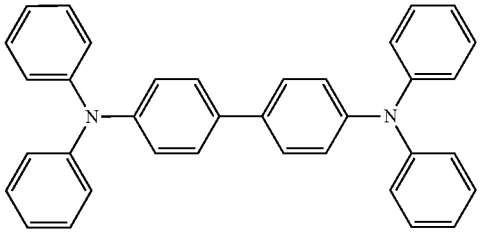
II-24
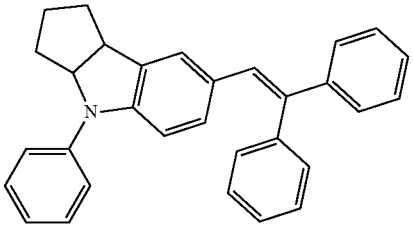
II-25
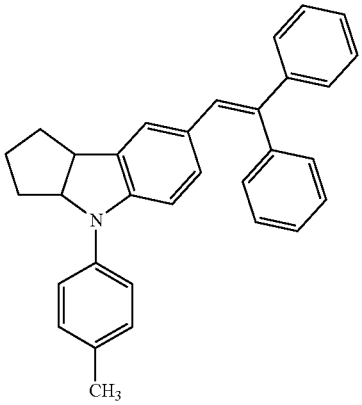
II-26
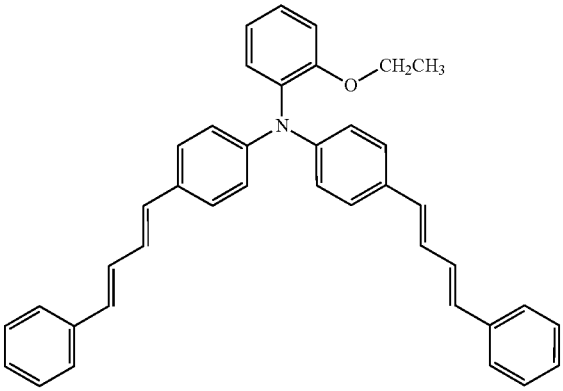
II-27
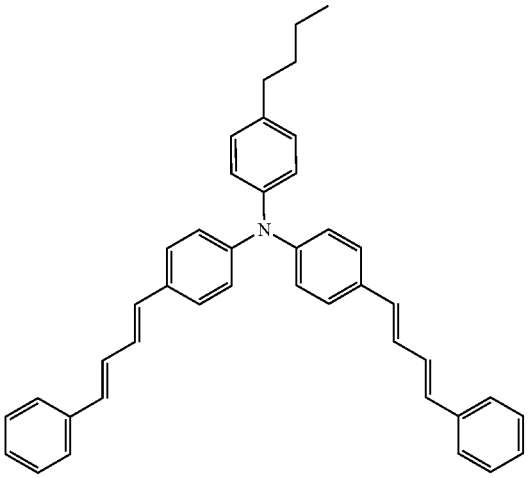
II-28
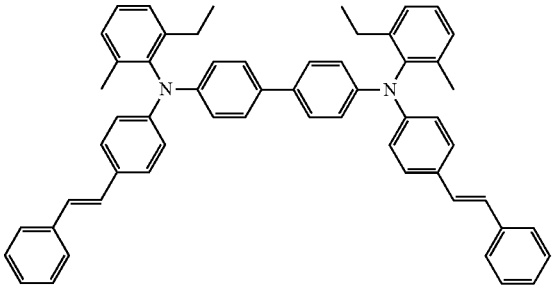

-continued

II-29

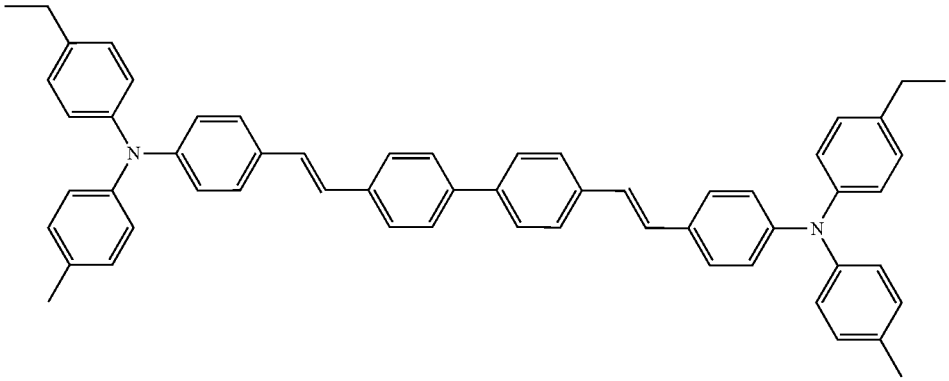

II-30

(1)

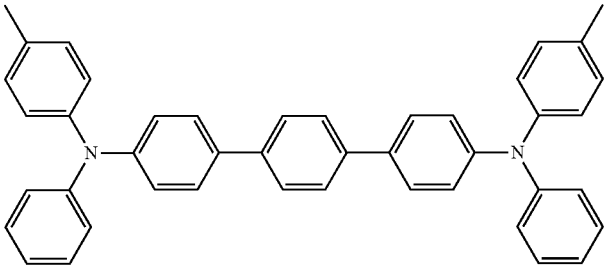

(2)

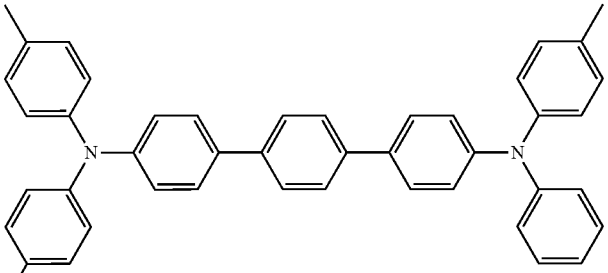

(3)

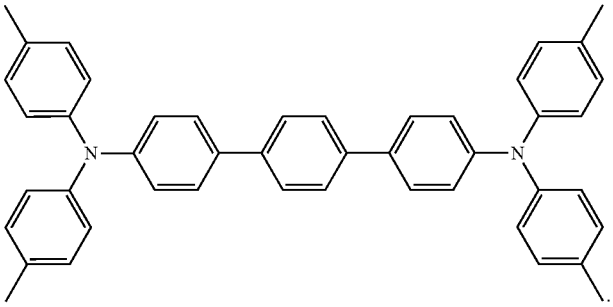

(1):(2):(3) = 1:2:3

In the photoreceptor according to the embodiment of the present invention, the photosensitive layer preferably contains an inorganic or organic filler. More specifically, by incorporating an inorganic or organic filler into a layer which constitutes the outermost surface layer among the constituent layers of the photosensitive layer of the photoreceptor, the surface of the photoreceptor can be made less susceptible to wear, allowing for a contribution to a longer life. In the negatively-charged laminated photoreceptor, an inorganic or organic filler can be incorporated into the charge transport layer 5. Examples of such an inorganic filler include: fillers containing silica as a main component; and particles of alumina, zirconia, titanium oxide, tin oxide, calcium oxide, zinc oxide and the like. Examples of such an organic filler include polytetrafluoroethylene (PTFE) particles. In the case of incorporating an inorganic or organic filler to the charge transport layer 5, the content of the filler is from 1 to 40% by mass, and more suitably from 2 to 30% by mass with respect to the solid content of the charge transport layer 5.

Among the above described fillers, the organic filler suitably has a primary particle size of 1 nm or more and 2,000 nm or less, and more preferably 1 nm or more and 1,000 nm or less, and still more preferably 1 nm or more and 700 nm or less.

The inorganic filler is preferably a filler containing silica as a main component. Examples of known methods for producing silica particles having a particle size of from about several nm to several ten nm, to be used as the above mentioned silica, include: a method referred to as a "wet process", in which water glass is used as a raw material; a method referred to as a "dry process" in which chlorosilane or the like is allowed to react in a gas phase; and a method in which an alkoxide as a silica precursor is used as a raw material.

At this time, if a large amount of dissimilar metals are present as impurities in silica, when subjecting the silica to a surface treatment, the presence of the metals at sites different from those of usual metal oxides causes defects, and this leads to changes in charge distribution on the surface. These sites act as starting points to increase the cohesiveness of oxide particles, as a result of which the amount of aggregates in the coating liquid and the photosensitive layer silica is increased. Therefore, it is preferred that the silica to be used have a high purity. Accordingly, the contents of metals other than the metal element constituting the inorganic filler are preferably adjusted to 1,000 ppm or less per each metal element.

On the other hand, it is suitable to add an extremely trace amount of dissimilar metals, so that a surface treatment agent is allowed to sufficiently react, to improve the activity on the silica surface. The surface treatment agent reacts with hydroxyl groups present on the silica surface. When the silica contains a trace amount of other metal elements, the reactivity of silanol groups (hydroxyl groups) adjacent to the other metal elements present on the silica surface is improved, due to the effect caused by the difference in electronegativity between the metals. Since the hydroxyl groups have a high reactivity with the surface treatment agent, and thus react with the surface treatment agent more strongly than other hydroxyl groups. However, at the same time, the hydroxyl groups cause the formation of aggregates, if they remain unreacted. When other hydroxyl groups are allowed to react with the surface treatment agent, after the reaction of the above described hydroxyl groups therewith, it is thought that the cohesiveness of silica particles is greatly reduced due to the effect of the surface treatment agent as well as the effect of the dissimilar metals on the surface to reduce uneven surface charge distribution. In cases where the inorganic filler contains a trace amount of other metals, the surface treatment agent exhibits a better reactivity, as a result of which the dispersibility provided by the surface treatment is improved, and thus is preferred.

When aluminum element is added to silica in an amount up to the range of 1,000 ppm or less, it is suitable for carrying out the surface treatment. The amount of aluminum element in the silica can be controlled by any of the methods disclosed in JP2004-143028A, JP2013-224225A, JP2015-117138A and the like. However, the adjustment method is not particularly limited, as long as the amount of aluminum element can be adjusted within a desired range. Specific examples of the method of controlling the amount of aluminum element on the silica surface, in a more suitable manner, include the following methods. One example is a method in which silica fine particles are first allowed to grow to a particle size smaller than the intended silica particle size, during the production of the silica fine particles, followed by addition of an aluminum alkoxide which serves as an aluminum source, for example, to control the amount of aluminum on the silica surface. Other examples include: a method in which silica fine particles are introduced into a solution containing aluminium chloride so as to coat the solution of aluminium chloride on the surface of the silica fine particles, followed by drying and baking; and a method in which silica is allowed to react with a mixed gas of a halogenated aluminum compound and a halogenated silicon compound.

It is known that silica has a structure in which a plurality of silicon atoms and oxygen atoms are linked in a cyclic manner to form a mesh-like bonding structure. When silica contains aluminum element, the number of atoms constituting the cyclic structure of silica becomes greater than that of regular silica, due to the effect of mixing aluminum. This effect leads to a reduced steric hindrance when the surface treatment agent reacts with hydroxyl groups present on the surface of silica containing aluminum element, as compared to the steric hindrance on the surface of regular silica. As a result, the reactivity of the surface treatment agent is improved, and the resulting surface treated silica has an improved dispersibility, as compared to that obtained by allowing the same surface treatment agent to react with regular silica.

From the viewpoint of controlling the amount of aluminum element, silica produced by the wet process is more suitable. Further, the content of aluminum element with respect to the amount of silica is suitably 1 ppm or more, in view of the reactivity of the surface treatment agent.

The form of the inorganic filler is not particularly limited. However, in order to reduce the cohesiveness so as to achieve a uniformly dispersed state, the inorganic filler preferably has a sphericity of 0.8 or more, and more preferably 0.9 or more.

Further, the primary particle size of the inorganic oxide is suitably from 1 to 200 nm, more preferably from 5 to 100 nm, and still more preferably from 10 to 50 nm. The particles being dispersed may be in the form of primary particles, or may form clusters of several particles.

The average distance between the particles of the inorganic filler, in the photosensitive layer, is not particularly limited. However, a distance close to the primary particle size of the particles is preferred, since such a distance eventually leads to an enhanced binding force between film components due to interaction between particles, and to a reduced wear of the film. Specifically, the average distance is preferably 200 nm or less, and more preferably 70 nm or less.

In cases where the inorganic filler is used in a charge transport layer of a photoreceptor which is expected to provide a high resolution, it is preferred to take into consideration the effect of α-ray or the like, derived from a material added to the charge transport layer. In the case of a semiconductor memory element, for example, the memory element retains the type of data to be stored depending on the presence or absence of charge accumulation. However, as a result of miniaturization, the amount of charge accumulation is also reduced, and the type of the data is altered by electric charges which could be altered by the α-ray irradiated from the exterior of the memory element, resulting in an unexpected data alteration. Further, since the size of the current flowing in the semiconductor element is also reduced, the current (noise) generated by the α-ray is relatively increased as compared to the size of signals, resulting in a risk of malfunction. Considering the effect on the behavior of electric charges in the charge transport layer of the photoreceptor, in the same manner as the above described phenomenon, it is more suitable to use a material which generates a smaller amount of α-ray, as a film constituent material. Specifically, it is effective to reduce the concentrations of uranium and thorium in the inorganic filler, and preferably, the concentration of thorium is 30 ppb or less, and the concentration of uranium is 1 ppb or less.

The production method which enables to reduce the amounts of uranium and thorium in the inorganic filler can be found, for example, in JP 2013-224225 A and the like. However, the method is not particularly limited thereto, as long as the concentrations of these elements can be reduced.

It is possible to perform a surface treatment on the surface of the inorganic filler. A commercially available surface treatment agent can be used, as the surface treatment agent to be used. More preferably, a silane coupling agent is used. Examples of the silane coupling agent include phenyltrimethoxysilane, vinyltrimethoxysilane, epoxytrimethoxysilane, methacryltrimethoxysilane, aminotrimethoxysilane, ureidetrimethoxysilane, mercaptopropyltrimethoxysilane, isocyanatepropyltrimethoxysilane, phenylaminotrimethoxysilane, acrylic trimethoxysilane, p-styryltrimethoxysilane, 3-acroxypropyltrimethoxysilane, 3-methacryloxypropyltrimethoxysilane, 3-isocyanateeropyltrimethoxysilane, 3-aminopropyltrimethoxysilane and N-phenyl-3-aminopropyltrimethoxysilane. It is possible to use a silane coupling agent containing at least one of the above described compounds. Further, the alkyl group in the alkoxide is preferably methyl group. However, ethyl group, propyl group and butyl group are also preferred, in addition to methyl group. The amount of the surface treatment agent to be used in the treatment is such that the amount of the surface treatment agent is from 0.01 to 10.0% by mass, preferably from 0.05 to 5.0% by mass, with respect to the mass of the inorganic filler after the treatment.

More specific examples of the silane coupling agent to be used in the embodiment of the present invention include compounds having a structure represented by the following general formula (1); however, the silane coupling agent is not particularly limited to the compounds of the following formula, as long as it is a compound capable of undergoing a condensation reaction with a reactive group such as hydroxyl group present on the surface of the inorganic filler:

$$(R^1)_n—Si—(OR^2)_{4-n} \quad (1)$$

where Si represents a silicon atom; $R^1$ represents an organic group having a structure in which a carbon atom is directly bound to the silicon atom; $R^2$ represents an organic group; and n represents an integer of from 0 to 3.

In an organic silicon compound represented by the general formula (1), examples of the organic group represented by $R^1$ include: alkyl groups such as methyl, ethyl, propyl, butyl, pentyl, hexyl, octyl and dodecyl groups; aryl groups such as phenyl, tolyl, naphthyl and biphenyl groups; epoxy-containing groups such as γ-glycidoxypropyl and β-(3,4-epoxycyclohexyl)ethyl groups; (meth)acryloyl-containing groups such as γ-acryloxypropyl and γ-methacryloxypropyl groups; hydroxyl-containing groups such as γ-hydroxypropyl and 2,3-dihydroxypropyloxypropyl groups; vinyl-containing groups such as vinyl and propenyl groups; mercapto-containing groups such as γ-mercaptopropyl group; amino-containing groups such as p-aminophenyl, γ-aminopropyl, N-β(aminoethyl)-γ-aminopropyl and N-phenyl-3-aminopropyl groups; halogen-containing groups such as m-aminophenyl, o-aminophenyl, γ-chloropropyl, 1,1,1-trifluoropropyl, nonafluorohexyl and perfluorooctylethyl groups; and nitro-substituted and cyano-substituted alkyl groups. Examples of a hydrolyzable group represented by $OR^2$ include alkoxy groups such as methoxy and ethoxy groups; halogen groups; and acyloxy groups.

The silane coupling agent represented by the general formula (1) may be used singly, or two or more kinds thereof may be used in combination. In cases where a plurality of kinds of the above described coupling agents are used in combination, the two kinds of coupling agents can be allowed to react with the inorganic filler simultaneously, but it is also possible to allow each of the plurality of coupling agents to react sequentially with the inorganic filler.

In cases where n is 2 or more, in the silane coupling agent represented by the general formula (1), a plurality of $R^1$s may be the same as, or different from, each other. Likewise, in cases where n is 2 or less, the plurality of $R^2$s may be the same as, or different from, each other. Further, in cases where two or more kinds of the organic silicon compounds represented by the general formula (1) are used as the coupling agents, $R^1$s and $R^2$s in the respective coupling agents may be the same as, or different from, each other.

Examples of the compound in which n is 0 include the following compounds. Specifically, examples include tetramethoxysilane, tetraacetoxysilane, tetraethoxysilane, tetraallyloxysilane, tetrapropoxysilane, tetraisopropoxy silane, tetrakis(2-methoxyethoxy)silane, tetrabutoxysilane, tetraphenoxysilane, tetrakis(2-ethylbutoxy)silane and tetrakis(2-ethylhexyloxy)silane.

Examples of the compound in which n is 1 include the following compounds. Specifically, examples include methyltrimethoxysilane, mercaptomethyltrimethoxysilane, trimethoxyvinylsilane, ethyltrimethoxysilane, 3,3,3-trifluoropropyltrimethoxysilane, 3-chloropropyltrimethoxysilane, triethoxysilane, 3-mercaptopropyltrimethoxysilane, 3-aminopropyltrimethoxysilane, 2-aminoethylaminomethyltrimethoxysilane, methyltriacetoxysilane, chloromethyltriethoxysilane, ethyltriacetoxysilane, phenyltrimethoxysilane, 3-allylthiopropyltrimethoxysilane, 3-glycidoxypropyltrimethoxysilane, 3-bromopropyltriethoxysilane, 3-allylaminopropyltrimethoxysilane, propyltriethoxysilane, hexyltrimethoxysilane, 3-aminopropyltriethoxysilane, N-phenyl-3-aminopropyltrimethoxysilane, 3-methacryloxypropyltrimethoxysilane, bis(ethylmethylketoxime)methoxymethylsilane, pentyltriethoxysilane, octyltriethoxysilane and dodecyl triethoxysilane.

Examples of the compound in which n is 2 include the following compounds. Specifically, examples include dimethoxymethylsilane, dimethoxydimethylsilane, diethoxysilane, diethoxymethylsilane, dimethoxymethyl-3,3,3-trifluoropropylsilane, 3-chloropropyldimethoxymethylsilane, chloromethyldiethoxysilane, diethoxydimethylsilane, dimethoxy-3-mercaptopropylmethylsilane, diacetoxymethylvinylsilane, diethoxymethylvinylsilane, 3-aminopropyldiethoxymethylsilane, 3-(2-aminoethylaminopropyl) dimethoxymethylsilane, 3-methacryloxypropyldimethoxymethylsilane, 3-(3-cyanopropylthiopropyl)dimethoxymethylsilane, 3-(2-acetooxyethylthiopropyl)dimethoxymethylsilane, dimethoxymethyl-2-piperidinoethylsilane, dibutoxydimethylsilane, 3-dimethylaminopropyldiethoxymethylsilane, diethoxymethylphenylsilane, diethoxy-3-glycidoxypropylmethylsilane, 3-(3-acetoxypropylthio)propyldimethoxymethylsilane, dimethoxymethyl-3-piperidinopropylsilane and diethoxymethyloctadecylsilane.

Examples of the compound in which n is 3 include the following compounds. Specifically, examples include methoxytrimethylsilane, ethoxytrimethylsilane, methoxydimethyl-3,3,3-trifluoropropylsilane, 3-chloropropylmethoxydimethylsilane and methoxy-3-mercaptopropylmethylmethylsilane.

The coating liquid of the photosensitive layer according to the embodiment of the present invention may contain a trace amount of a hydrolyzate of the silane coupling agent. Specifically, the coating liquid may contain 2% by mass or less of a compound having a structure represented by the following general formula (2):

$$Si(OH)_m(R^1)_n(OR^2)_{4-(n+m)} \quad (2)$$

wherein Si represents a silicon atom; $R^1$ represents an organic group having a structure in which a carbon atom is directly bound to the silicon atom; $R^2$ represents an organic group; m represents an integer of from 1 to 4; n represents an integer of from 0 to 3; and the sum of m+n is 4 or less.

In cases where the inorganic filler is surface treated with a plurality of kinds of surface treatment agents, in a surface treatment step, respective surface treatments using the respective surface treatment agents may be carried out in any order. However, in cases where the inorganic filler is surface treated with a plurality of kinds of silane coupling agents, for example, it is preferred that a silane coupling agent having a structure represented by the general formula (1) be used in the first surface treatment. Further, in the surface treatment step, silica may be surface treated simultaneously with a silane coupling agent and an organosilazane, or alternatively, silica may be surface treated with a silane coupling agent, and then surface treated with an organosilazane. Still alternatively, silica may be first surface treated with an organosilazane, and then surface treated with a silane coupling agent, followed by a further surface treatment with an organosilazane.

The content of the resin binder in the charge transport layer 5 is suitably from 20 to 90% by mass, and more suitably from 30 to 80% by mass, with respect to the solid content of the charge transport layer 5 excluding the inorganic or organic filler. The content of the charge transport material in the charge transport layer 5 is suitably from 10 to 80% by mass, and more suitably from 20 to 70% by mass, with respect to the solid content of the charge transport layer 5 excluding the inorganic or organic filler.

The charge transport layer 5 preferably has a film thickness within a range of from 3 to 50 μm, more preferably within a range of from 15 to 40 μm, in order to maintain a practically effective surface potential.

(Positively-Charged Monolayer Photoreceptor)

In the case of the positively-charged monolayer photoreceptor, the monolayer photosensitive layer 3 constitutes the outermost surface layer of the photoreceptor. In the positively-charged monolayer photoreceptor, the monolayer photosensitive layer 3 is mainly composed of the charge generation material, a hole transport material and an electron transport material (acceptor compound) as the charge transport material, and a resin binder.

Examples of the resin binder which can be used in the monolayer photosensitive layer 3 include: various types of polycarbonate resins such as bisphenol A polycarbonates, bisphenol Z polycarbonates, bisphenol A polycarbonate-biphenyl copolymers and bisphenol Z polycarbonate-biphenyl copolymers; polyphenylene resins; polyester resins; polyvinyl acetal resins; polyvinyl butyral resins; polyvinyl alcohol resins; vinyl chloride resins; vinyl acetate resins; polyethylene resins; polypropylene resins; acrylic resins; polyurethane resins; epoxy resins; melamine resins; silicone resins; polyamide resins; polystyrene resins; polyacetal resins; polyarylate resins; polysulfone resins; methacrylate polymers; and copolymers of these resins. Further, the same kind of resins having different molecular weights may be used as a mixture.

Examples of the charge generation material which can be used in the monolayer photosensitive layer 3 include phthalocyanine pigments, azo pigments, anthanthrone pigments, perylene pigments, perinone pigments, polycyclic quinone pigments, squarylium pigments, thiapyrylium pigments, and quinacridone pigments. These charge generation materials can be used singly, or two or more kinds of these materials can be used in combination. In particular, in the photoreceptor according to the present invention, disazo pigments and trisazo pigments are preferably used as azo pigments, N,N'-bis(3,5-dimethylphenyl)-3,4:9,10-perylene-bis(carboxyimide) is preferably used as a perylene pigment, and metal-free phthalocyanine, copper phthalocyanine and titanyl phthalocyanine are preferably used as phthalocyanine pigments. Further, the use of the following compounds enables to exhibit a markedly improved sensitivity, durability and image quality, and thus is preferred: X-type metal-free phthalocyanine, τ-type metal-free phthalocyanine, ε-type copper phthalocyanine, α-type titanyl phthalocyanine, β-type titanyl phthalocyanine, Y-type titanyl phthalocyanine, amorphous titanyl phthalocyanine, and titanyl phthalocyanines which are disclosed in JPH08-209023A, U.S. Pat. Nos. 5,736,282A and 5,874,570A, and in which the Bragg angle 2θ has a maximum peak at 9.6°, in an X-ray diffraction spectrum using CuKα.

Examples of the hole transport material which can be used in the monolayer photosensitive layer 3 include hydrazone compounds, pyrazoline compounds, pyrazolone compounds, oxadiazole compounds, oxazole compounds, aryl amine compounds, benzidine compounds, stilbene compounds, styryl compounds, poly-N-vinylcarbazoles and polysilanes. These hole transport materials can be used singly, or two or more kinds of these materials can be used in combination. The hole transport material to be used in the present invention is preferably one which has an excellent ability to transport holes generated upon light irradiation, and which is suitable for use in combination with the charge generation material.

Examples of the electron transport material (acceptor compound) to be used in the monolayer photosensitive layer 3 include succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compounds, quinone compounds, benzoquinone compounds, diphenoquinone compounds, naphthoquinone compounds, anthraquinone compounds, stilbenequinone compounds and azoquinone compounds. These electron transport materials can be used singly, or two or more kinds of these materials can be used in combination.

An inorganic or organic filler can be incorporated into the monolayer photosensitive layer 3. As the inorganic filler and the organic filler, the same fillers as those described above can be used. In the case of incorporating the inorganic or organic filler into the monolayer photosensitive layer 3, the content thereof is from 1 to 40% by mass, and more suitably from 2 to 30% by mass, with respect to the solid content of the monolayer photosensitive layer 3.

The content of the resin binder in the monolayer photosensitive layer 3 is suitably from 10 to 90% by mass, and more suitably from 20 to 80% by mass, with respect to the solid content of the monolayer photosensitive layer 3 excluding the inorganic or organic filler. The content of the charge generation material in the monolayer photosensitive layer 3 is suitably from 0.1 to 20% by mass, and more suitably from 0.5 to 10% by mass, with respect to the solid content of the monolayer photosensitive layer 3 excluding the inorganic or organic filler. The content of the hole transport material in the monolayer photosensitive layer 3 is suitably from 3 to 80% by mass, and more suitably from 5 to 60% by mass, with respect to the solid content of the monolayer photosensitive layer 3 excluding the inorganic or organic filler. The content of the electron transport material in the monolayer photosensitive layer 3 is suitably from 1 to 50% by mass, and more suitably from 5 to 40% by mass, with respect to the solid content of the monolayer photosensitive layer 3 excluding the inorganic or organic filler.

The monolayer photosensitive layer 3 preferably has a film thickness within a range of from 3 to 100 μm, and more preferably within a range of from 5 to 40 μm, in order to maintain a practically effective surface potential.

(Positively-Charged Laminated Photoreceptor)

In the positively-charged laminated photoreceptor, the photosensitive layer includes: the charge transport layer 5; and the charge generation layer 4; in this order from the side of the electrically conductive support 1. In the case of the positively-charged laminated photoreceptor, the charge generation layer 4 constitutes the outermost surface layer of the photoreceptor. In the positively-charged laminated photoreceptor, the charge transport layer 5 is mainly composed of a charge transport material and a resin binder. As such a charge transport material and resin binder, it is possible to use the same materials as those exemplified for the charge transport layer 5 in the negatively-charged laminated photoreceptor. The contents of the respective materials and the film thickness of the charge transport layer 5 may also be the same as those described for the negatively-charged laminated photoreceptor.

The charge generation layer 4, which is provided on the charge transport layer 5, is mainly composed of the charge generation material, a hole transport material and an electron transport material (acceptor compound) as the charge transport material, and a resin binder. As the charge generation material, the hole transport material, the electron transport material, and the resin binder, it is possible to use the same materials as those exemplified for the monolayer photosensitive layer 3 in the monolayer photoreceptor. The contents of the respective materials and the film thickness of the charge generation layer 4 may also be the same as those described for the monolayer photosensitive layer 3 in the monolayer photoreceptor.

In the positively-charged laminated photoreceptor, an inorganic or organic filler can be incorporated into the charge generation layer 4. As the inorganic filler and the organic filler, the same fillers as those described above can be used. In the case of incorporating the inorganic or organic filler into the charge generation layer 4, the content thereof is from 1 to 40% by mass, and more suitably from 2 to 30% by mass, with respect to the solid content of the charge generation layer 4.

In the present invention, a leveling agent such as a silicone oil or a fluorine-based oil can be incorporated into any of the laminated and monolayer photosensitive layers, for the purposes of improving the leveling properties of the formed film, and imparting lubricity. Further, it is also possible to incorporate other known additives, as required, to the extent that the electrophotographic properties are not markedly impaired.

In addition, an antidegradant, such as an antioxidant or a photostabilizer, can be incorporated into the photosensitive layer, for the purpose of improving environmental resistance and stability to harmful light. Examples of the compound to be used for such a purpose include: chromanol derivatives such as tocopherol, as well as esterified compounds, polyarylalkane compounds, hydroquinone derivatives, etherified compounds, dietherified compounds, benzophenone derivatives, benzotriazole derivatives, thioether compounds, phenylenediamine derivatives, phosphonic acid esters, phosphorous acid esters, phenolic compounds, hindered phenol compounds, linear amine compounds, cyclic amine compounds and hindered amine compounds.

(Method of Producing Electrically Conductive Support)

Figure 5:
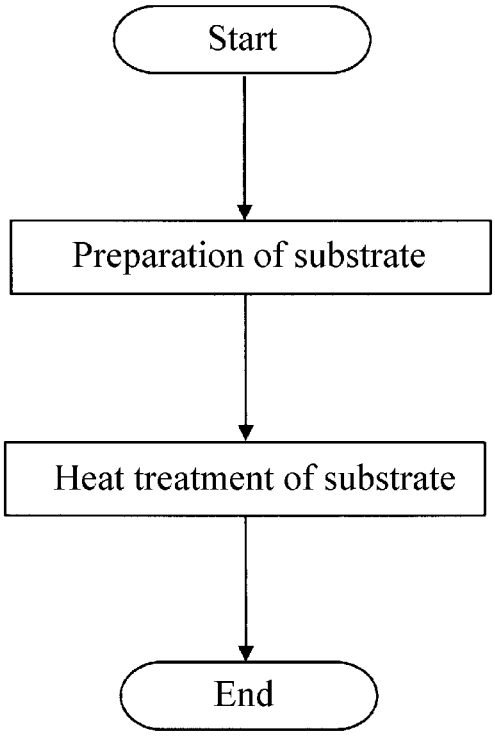
FIG. 5 is a flow chart of a method of producing the electrically conductive support according to the present invention.

FIG. 5 shows a flow chart of a method of producing the electrically conductive support according to the present invention. In order to produce the electrically conductive support according to the present invention, the method of producing the electrically conductive support according to the present invention includes: preparing a substrate which contains an aluminum alloy and which is obtained at least through an extrusion step; and heat treating the substrate to obtain the electrically conductive support. The heat treatment is carried out such that, when the temperature of the heat treatment is defined as T (° C.) and the time of the heat treatment is defined as H (hours), an amount of heat treatment Q defined by Q=T×H is 800 or less, and suitably 600 or less. By this arrangement, it is possible to obtain the electrically conductive support 1 having a predetermined stress value, without causing a decrease in rigidity. The amount of heat treatment Q is adjusted within the above described range, because an excessive heat treatment causes a decrease in the rigidity of the electrically conductive support 1. Further, the amount of heat treatment Q is preferably adjusted to 50 or more, because an insufficient heat treatment results in a failure to obtain a desired stress value.

The substrate to be subjected to the heat treatment is a substrate obtained through at least the extrusion step, and may be one which has further been subjected to a drawing step, and which has further been subjected to a cutting step. It is possible to obtain the electrically conductive support 1 having a predetermined stress value: by subjecting the substrate to the heat treatment, followed by the cutting step, or followed by both the drawing step and the cutting step; or alternatively, by subjecting the substrate only to a heat treatment. In other words, in the present invention, the heat treatment on the substrate may be carried out at any of the time points: between the extrusion step and the drawing step; between the drawing step and the cutting step; between the extrusion step and the cutting step; and after the completion of the cutting step. It is preferred to carry out the heat treatment on the substrate after the extrusion step, or after the extrusion step and the drawing step, because the stress (strain) generated in the substrate by these steps can be reduced before carrying out the final finish (cutting step). The heat treatment is usually carried out once; however, the heat treatment may be carried out for a plurality of times.

The heat treatment is required to be carried out under the conditions where the amount of heat treatment Q is within the above described range. Specifically, the temperature of the heat treatment can be selected, for example within a range of 50° C. or higher and 400° C. or lower, and the time of the heat treatment can be selected, for example, within a range of 1 hour or more and 2 hours or less. The temperature of the heat treatment is preferably selected within a range of 50° C. or higher and 300° C. or lower, and more preferably within a range of 50° C. or higher and 200° C. or lower. Further, the heat treatment can be carried out under the atmospheric pressure; however, the heat treatment may also be carried out under reduced pressure or in vacuum, without particular limitations.

In the production method according to the embodiment of the present invention, extrusion processing, drawing processing and cutting processing of the electrically conductive support 1 can be carried out in accordance with ordinary methods, without particular limitations. A photoreceptor can be produced by forming a photosensitive layer on the electrically conductive support 1 obtained as described above, in accordance with an ordinary method, for example, by a dip coating method or the like, with an undercoat layer interposed therebetween, as desired. The undercoat layer and the photosensitive layer are formed at a temperature of 200° C. or lower, preferably a temperature of 150° C. or lower.

(Electrophotographic Device)

The photoreceptor according to the present invention provides expected effects when used in various types of machine processes. Specifically, sufficient effects can be obtained even in: charging processes such as contact charging systems using a charging member such as a roller or a brush, and non-contact charging systems using a corotron, a scorotron or the like; as well as in development processes such as contact and non-contact development systems, using a non-magnetic single-component development system, a magnetic single-component development system, a magnetic two-component development system, and the like.

Figure 6:
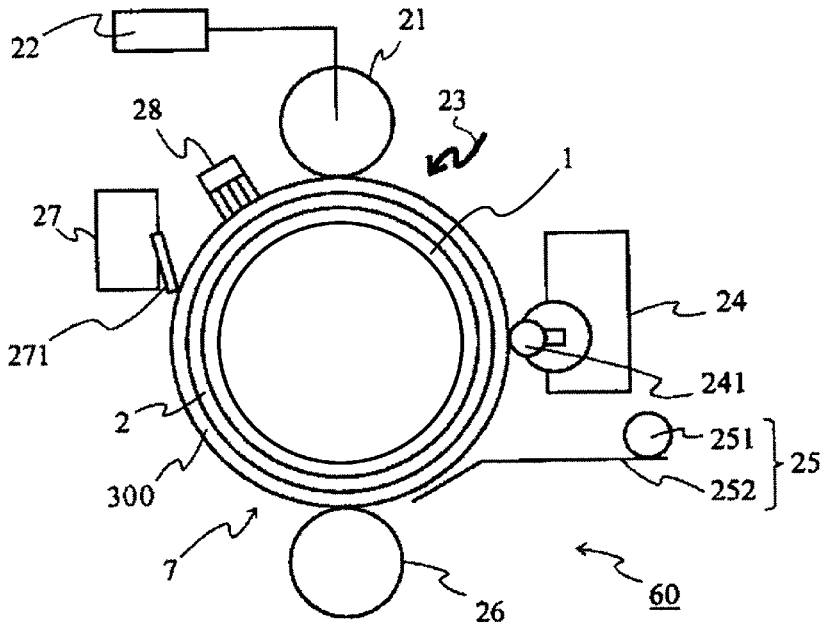
FIG. 6 is a schematic diagram showing one example of an electrophotographic device according to the present invention.

An electrophotographic device according to the present invention is an electrophotographic device including the above described photoreceptor according to the present invention. FIG. 6 shows a schematic diagram of one configuration example of an electrophotographic device according to the present invention. An electrophotographic device 60 shown in FIG. 6 includes a photoreceptor 7 including: an electrically conductive support 1; and an undercoat layer 2 and a photosensitive layer 300 coated on the outer peripheral surface of the electrically conductive support 1. The electrophotographic device 60 includes: a charging member 21 disposed at the outer peripheral edge of the photoreceptor 7; a high voltage power supply 22 for supplying a voltage to be applied to the charging member 21; an image exposure member 23; a developer 24 including a developing roller 241; a paper feed member 25 including a paper feed roller 251 and a paper feed guide 252; and a transfer charging unit (direct charging type) 26. The electrophotographic device 60 may further include: a cleaning device 27 including a cleaning blade 271; and a destaticizing member 28. Further, the electrophotographic device 60 can be a color printer.

EXAMPLES

Specific embodiments of the present invention will now be described in further detail, with reference to Examples. The present invention is in no way limited by the following Examples, as long as the gist of the present invention is not deviated.

An aluminum alloy substrate prepared from an ingot of an aluminum alloy (A6063) through an extrusion step and a drawing step was subjected to a heat treatment under the atmospheric pressure and according to the conditions shown in the Table below. Thereafter, the substrate was subjected to the cutting step, to obtain an electrically conductive support in the form of a straight tube having an outer diameter and a thickness shown in the Table below. The resulting electrically conductive support has a length of 260.5 mm. The stress value, the deflection accuracy, the rigidity, and the cost performance of the thus obtained electrically conductive support were evaluated according to the following methods.

(Evaluation of Stress Value)

The stress value of the thus obtained electrically conductive support was measured, using Auto Mate II manufactured by Rigaku Corporation as a stress value measuring device. The mean value of the measured stress values of five pieces of the electrically conductive supports was taken as the stress value.

(Evaluation of Deflection Accuracy)

Figure 7:
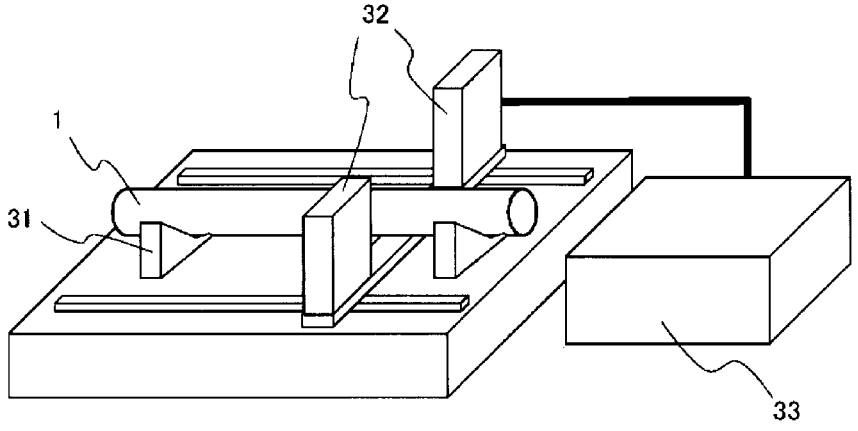
FIG. 7 is an explanatory diagram showing an apparatus for evaluating deflection accuracy used in Examples.

The deflection accuracy (deflection) of the thus obtained electrically conductive support was evaluated, using an evaluation apparatus as shown in FIG. 7 (a laser micrometer manufactured by Keyence Corporation (resolution: 1/1,000 mm, rotational velocity: 20±5 rpm)). As shown in the figure, a laser sensor 32 was allowed to move in the longitudinal direction of the electrically conductive support 1, in a state where both end portions of the electrically conductive support 1 in the longitudinal direction were each supported by a V-shaped block 31, to measure the deflection of the electrically conductive support 1. In each of the Examples and Comparative Examples, five pieces of the electrically conductive supports 1 were prepared; the measurement of the deflection was carried out at five locations in each support 1; and the maximum value of the measured values was taken as the deflection value of the support 1 in each Example. The measurement was carried out at five locations, which correspond to the locations determined by dividing the length of the electrically conductive support 1 into 6 equal parts, excluding both ends. Reference numeral 33 in the figure indicates a controller.

(Evaluation of Rigidity)

Measurement of film hardness (HU) was carried out for each electrically conductive support, using MZT-522 manufactured by Mitutoyo Corporation (load: 200 mH; indenter: triangular pyramid, 65.03°), and the rigidity of the electrically conductive support was evaluated in accordance with the following criteria:

○: when the film hardness (HU) is 100 or more;

Δ○: when the film hardness (HU) is 80 or more and less than 100;

Δ: when the film hardness (HU) is 70 or more and less than 80; and

Δx: when the film hardness (HU) is less than 70.

(Evaluation of Cost Performance)

Evaluation of cost performance was carried out for each electrically conductive support in accordance with the following criteria:

◎: when the amount of heat treatment is 300 or less;

○: when the amount of heat treatment is more than 300 and 600 or less;

Δ○: when the amount of heat treatment is more than 600 and 1,000 or less; and x: when the amount of heat treatment is more than 1,000.

These results are also shown in the following Table.

TABLE 1

| | Heat treatment conditions | | | | Electrically conductive support | | | | |
|---|---|---|---|---|---|---|---|---|---|
| | Stress value (MPa) | Temperature T (° C.) | Time H (h) | Amount of heat treatment*1 (° C. · h) | Outer diameter (mm) | Thickness (mm) | Deflection (μm) | Rigidity | Cost performance |
| Comparative Example 1 | −50 | — | — | — | 40 | 0.8 | 40 | ○ | ◎ |
| Comparative Example 2 | −40 | 50 | 0.5 | 25 | 30 | 0.8 | 32 | ○ | ◎ |
| Comparative Example 3 | 10 | 300 | 4 | 1200 | 30 | 0.7 | 22 | Δ | X |
| Comparative Example 4 | 25 | 300 | 5 | 1500 | 24 | 0.6 | 24 | ΔX | X |
| Example 1 | −30 | 50 | 1 | 50 | 30 | 0.8 | 30 | ○ | ◎ |
| Example 2 | −25 | 50 | 1 | 50 | 24 | 0.5 | 26 | ○ | ◎ |
| Example 3 | −20 | 100 | 1 | 100 | 30 | 0.7 | 25 | ○ | ◎ |
| Example 4 | −18 | 100 | 1 | 100 | 24 | 0.7 | 24 | ○ | ◎ |
| Example 5 | −16 | 100 | 2 | 200 | 40 | 0.8 | 20 | ○ | ◎ |
| Example 6 | −15 | 100 | 2 | 200 | 24 | 0.6 | 15 | ○ | ◎ |
| Example 7 | −12 | 200 | 1.5 | 300 | 30 | 0.65 | 20 | ○ | ◎ |
| Example 8 | −10 | 200 | 1.5 | 300 | 24 | 0.5 | 18 | ○ | ◎ |
| Example 9 | −7 | 300 | 2 | 600 | 30 | 0.75 | 22 | ○ | ○ |
| Example 10 | −2 | 300 | 2 | 600 | 24 | 0.75 | 17 | ○ | ○ |
| Example 11 | 5 | 400 | 2 | 800 | 24 | 0.65 | 24 | Δ○ | Δ○ |

*1indicates the amount of heat treatment Q defined by Q = T × H, when the temperature of the heat treatment is defined as T (° C.) and the time of the heat treatment is defined as H (hours).

The results shown in the above described Table have confirmed that an electrically conductive support which satisfies a stress value according to the present invention is inexpensive, and at the same time, has a high accuracy while retaining rigidity. The electrically conductive supports obtained in Examples 5 to 8, and 10, each has a particularly favorable deflection of 20 μm or less.

DESCRIPTION OF SYMBOLS

1 electrically conductive support
2 undercoat layer
3 monolayer photosensitive layer
4 charge generation layer
5 charge transport layer
7 photoreceptor
11 main body
12A first end
12B second end
21 charging member
22 high voltage power supply
23 image exposure member
24 developer
241 developing roller
25 paper feed member
251 paper feed roller
252 paper feed guide
26 transfer charging unit (direct charging type)
27 cleaning device
271 cleaning blade
28 destaticizing member
31 V-shaped block
32 laser sensor
33 controller
60 electrophotographic device
300 photosensitive layer

What is claimed is:

1. An electrically conductive support for use in an electrophotographic photoreceptor, comprising:

a cylindrical main body having a first end, and a second end opposite to the first end in an axial direction of the main body, wherein the main body contains an aluminum alloy, and has an internal stress in a range of −30 MPa to 0 MPa.

2. The electrically conductive support according to claim 1, wherein the main body is a cylindrical tube, and wherein the cylindrical tube is a straight tube having the first end and the second end opposite to the first end in the longitudinal direction, the cylindrical tube having a constant inner outer diameter and a constant thickness an entire area between the first end and the second end.

3. The electrically conductive support according to claim 2, wherein the cylindrical tube has the outer diameter of 40 mm or less, and the thickness in a range of 0.5 mm to 0.8 mm.

4. The electrically conductive support according to claim 2, wherein the cylindrical tube has a deflection of 30 μm or less.

5. A method of producing the electrically conductive support according to claim 1, comprising:

preparing a substrate obtained from an extrusion process, the substrate containing an aluminum alloy; and heat treating the substrate to obtain the electrically conductive support, wherein the heat treating is carried out such that, when a temperature of the heat treating is defined as T (° C.) and a time of the heat treating is defined as H (hours), an amount of the heat treating Q defined by Q=T×H is 800 or less.

6. An electrophotographic photoreceptor, comprising:

the electrically conductive support according to claim 1; and a photosensitive layer disposed an outer surface of the main body.

7. The electrophotographic photoreceptor according to claim 6, wherein the photosensitive layer contains an inorganic or organic filler.

8. The electrophotographic photoreceptor according to claim 6, wherein the photosensitive layer contains at least a resin binder and a charge transport material.

9. An electrophotographic device comprising the electrophotographic photoreceptor according to claim 6.

* * * * *